United States Patent [19]

Lorenz

[11] Patent Number: 4,602,737

[45] Date of Patent: Jul. 29, 1986

[54] SHIPPING MAILER

[75] Inventor: Achim R. Lorenz, Atlanta, Ga.

[73] Assignee: MacMillan Bloedel Containers, Atlanta, Ga.

[21] Appl. No.: 683,102

[22] Filed: Dec. 18, 1984

[51] Int. Cl.[4] ..... B65D 65/12

[52] U.S. Cl. ..... 229/92.8; 229/75; 229/92; 383/119

[58] Field of Search ..... 383/127, 119, 115; 229/40, 87 R, 87 A, 92.8, 68 R, 75, 92

[56] References Cited

U.S. PATENT DOCUMENTS

| | | | |
|---|---|---|---|
| 21,403 | 9/1858 | Ayres . | |
| 402,335 | 4/1889 | Leclercq . | |
| 633,360 | 9/1899 | Ferres . | |
| 746,014 | 12/1903 | Callahan . | |
| 901,464 | 10/1908 | Ormston | 229/92.8 |
| 1,014,441 | 1/1912 | Benton . | |
| 1,133,522 | 3/1915 | Wordingham . | |
| 1,355,804 | 10/1920 | Baker . | |
| 1,706,300 | 3/1929 | Kakaley | 229/72 |
| 1,894,028 | 1/1933 | Deutschmeister | 229/75 |
| 1,918,384 | 7/1933 | Falvey . | |
| 2,330,619 | 9/1943 | Pomeranz . | |
| 2,846,060 | 8/1958 | Yount . | |
| 2,952,398 | 9/1960 | Gerard . | |
| 3,426,957 | 2/1969 | McCall . | |
| 3,884,352 | 5/1975 | Pilz, III et al. . | |
| 4,042,171 | 8/1977 | Ross et al. | 229/72 |
| 4,231,472 | 11/1980 | Dlugopolski . | |

FOREIGN PATENT DOCUMENTS

| | | | |
|---|---|---|---|
| 917013 | 9/1934 | United Kingdom | 229/92 |

*Primary Examiner*—Stephen P. Garbe
*Assistant Examiner*—Bryon Gehman
*Attorney, Agent, or Firm*—Beveridge, DeGrandi & Weilacher

[57] ABSTRACT

A mailer bag is fabricated from a rectilinear blank formed of paper, paperboard or the like and has two parallel score lines for folding, with one of the panels having a plurality of equally spaced, parallel cuts formed therein extending from one leading edge for a major portion of the length along the panel to a location near the opposite edge so that when folded over and glued, the uncut section serves to seal one end of the mailer. Glue is applied to alternate sites on the two end, or outer, panels so that when the cut end panel is folded over to meet with the center panel, and the other end panel is folded over on top of the other two panels, the cut panel sections will adhere in an alternating manner to the appropriate glued matching sections of the other two panels. The result is a mailer bag, open at one end, sealed at the opposite end, the walls of the mailer bag consisting of one of said panels and having adhered to the inside surface of each of said panel, a plurality, usually two, of equal sized, spaced apart sections of the cut panel.

14 Claims, 4 Drawing Figures

SHIPPING MAILER

This invention relates to a shipping mailer designed for the packaging, mailing and delivery of written or printed materials, documents, flat objects and other merchandise generally. Although preferably for use in the mailing or packaging of relatively flat items, the mailer bag of this invention may be used for mailing any item or object that can be conveniently fitted therein or accommodated thereby.

A variety of mailers have been described in the prior art and some of these are on the market. In general, the mailing bags now available require special materials and complicated apparatus for their manufacture. By and large, the prior mailing bags require more steps in their manufacture relative to the mailing bag of this invention.

It is among the objects of this invention to provide a new and improved mailer constructed of paperboard, cardboard or a similar material, which provides the structural rigidity necessary for the protected shipment of the contents thereof.

This invention contemplates an effective and novel means of enveloping essentially flat goods for mailing, using a simple panel folded twice to form three flaps with one of the flaps being partially cut into a plurality of strips which strips are then glued in an alternating fashion to the respective other two panels. The result is a mailer bag with one end sealed shut and the other end open to permit receiving the item to be mailed. The mailer bag has a plurality of strips adhered to the interior surfaces thereof for increased strength and stability.

Yet another object of this invention is to form a shipping mailer without the use of cumbersome apparatus and which can be formed more rapidly than prior known mailers.

This invention further contemplates the construction of a mailer from a blank without requiring folds to be made at right angles with one another. Thus, this invention provides a blank divided into three panels by two parallel score lines or creases thereby permitting the quick and simple folding of the three panels in an efficient repeated motion by the same machine, thus obviating a slower multi-angular folding process.

In a further aspect, the present invention resides in a mailer bag for the mailing of generally flat objects. The mailer itself is formed of a blank of paper, paperboard, corrugated cardboard or similar material which may be in the form of a large continuous roll of such material for continuous feeding to an automatic mail bag making machine. The blank is essentially flat as it is being processed by the apparatus and as it moves along in a continuous flow, two equally spaced score lines are placed on the blank in parallel to each other and parallel to the direction of paper movement. The score lines are on the same side of the blank to thereby delineate three panels in the blank, i.e. a center panel and two outer panels.

At the same time, or either before or after as may be convenient, a cutting device is arranged to cut a plurality (e.g. three) of parallel cuts in one of the end panels of the blank. The cuts are made in the panel from a point corresponding to the leading edge of the blank to a location that is proximate the edge of the panel opposite the point on the panel corresponding to the leading edge. The cuts extend from the leading edge of one panel up to a short distance before the end of the panel.

These cuts are made parallel to the score lines. Then the blank may be cut from the continuous roll.

Adhesive is applied to the two end panels in a spaced manner so that a plurality of parallel, spaced apart areas generally corresponding to the width of the plurality of strips having adhesive applied thereto is obtained. Any suitable adhesive may be used for purposes of the invention. The panels are folded so that the panel with the plurality of cuts is positioned inward from the other two panel sections. That is, the panel with the plurality of cuts is folded over first into the top surface of the center panel, and then the third panel, which is the other end panel, is folded over on top of the cut panel section to form a tube like mailer. The leading edge of the mailer then constitutes the opening to the mailer, while the opposite edge is sealed shut due to the fact that the blank is not cut through to the end. The end section of the mailer constitutes the closed end of the mailer. The mailer bag may be formed as a continuous, tube like structure with fully closed cross sections appearing at spaced intervals which is then cut when leaving the machine. Alternately, it may be cut before leaving the machine. By selectively positioning the glue or adhesive lines along the length of the panel parallel to the score lines and spaced in an alternating manner corresponding to the dimensions of the plurality of cut sections, the cut sections of the first end panel selectively adhere to either the portions of the center panel with which the glued sections come into contact, or they adhere to the section of the third panel with which the glued sections of the first end panel come into contact.

In the course of forming the adhesive bands or glue lines, the first cut section will, for example, adhere to the third or top panel, the adjacent cut section will adhere to the bottom or center panel, the next cut section will adhere to the top or third panel and so on to form the alternating construction of the mailer of this invention. Naturally, by changing the sequence of placing the glue lines, the corresponding sequence of glued sections will change.

The number of cuts can be varied as desired. Generally, each cut section will be of the same dimension; i.e. the cutters are spaced evenly.

The paperboard may be corrugated cardboard and the fluting may be widely varied as will be apparent to the art. Depending upon the amount of cushioning required, the size and nature of the fluting can be selected as desired. If corrugated paperboard is not needed, the blank may be formed of other paper type products.

Various other features and aspects of this invention will become apparent to those skilled in the art upon making reference to the detailed drawings and explanation below in which the preferred embodiment of the invention is presented and described.

The one piece blank of the invention is conveniently fabricated of, but not limited to, a corrugated cardboard construction, and the outside of the blank is capable of carrying any sort of indicia-bearing information.

Figure 1:
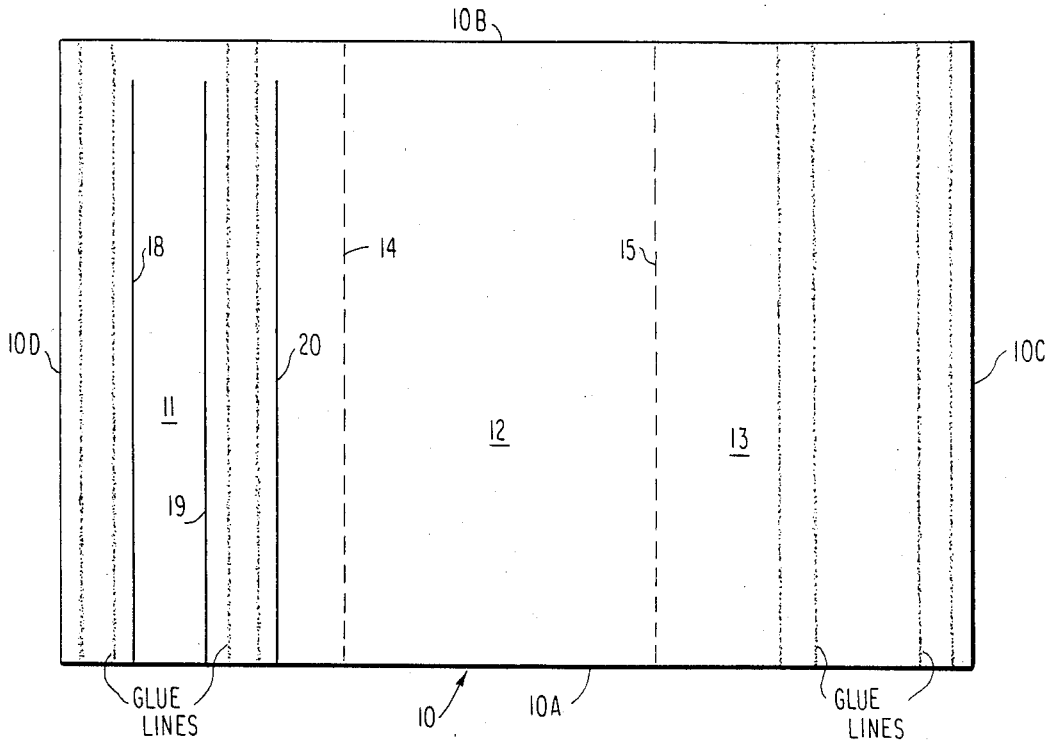
FIG. 1 is a plan view of a one piece blank used to construct the mailer bag of the invention.

Described in further detail, FIG. 1 shows the blank of the invention (10) as divided into a plurality of panels, in this case three, 11, 12 and 13 by parallel and equally spaced score lines 14 and 15 on the same side of the blank. The score lines are parallel to the direction of movement as the blank moves through the mailer bag making machine. The panel is rectilinear, i.e. rectangular in configuration having two parallel edges 10A and 10B, which are the leading edge and the side opposite the leading edge, respectively. The two parallel side edges are identified as 10C and 10D, respectively.

A plurality of cuts 18, 19, 20 are formed in one end panel 11, which cuts are parallel and equally spaced from each other, and are also parallel to the score lines 14 and 15. The cuts extend from leading edge 10A to a point proximate the opposite edge 10B. Generally, the cuts extend too close to the opposite edge 10B, for example, from $\frac{3}{4}$ to $2\frac{1}{2}$ inches from edge 10B. Preferably, the distance is about 1 inch, although this may vary. The purpose of the uncut end is to provide the seal for the mailer, as will be seen. Therefore, cut lines 18, 19 and 20 do not go through to the opposite edge 10B.

Two of the areas of end panels 11 and 13 receive application of adhesive as glue lines as shown by the shading. These glue lines are parallel to each other and parallel to the cut lines. The glue may be applied evenly or in a spot fashion. Panel 11 is then folded over onto center panel 12 and panel 13 is then folded over onto the rear side of panel 12. The adhesive glue lines having been applied in such a fashion so that the glued sections of panel 11 will adhere to the facing or top surface of center panel 12 and the glued sections of panel 13 will adhere to the back or reverse side of unglued sections of panel 11.

After the adhesive has set up, the several cut sections of panel 11 adhere in an alternating manner onto panel 12 and the glued sections of panel 13. Thus, when the mailer is opened, an alternating rib like structure is obtained with each rib being of the same width and dimension.

Figure 2:
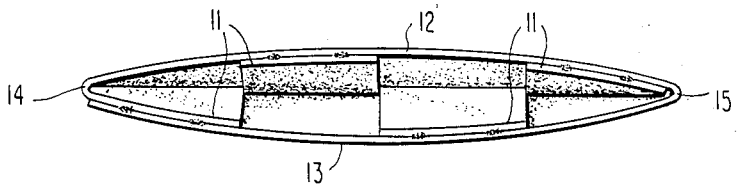
FIG. 2 is a cross-sectional view of the mailer bag in an open position, demonstrating the final configuration of the alternating strips.

The effect then is to have four strips alternating between top and bottom as is shown in FIG. 2. The glued sections of end panel 11 adheres to the opposite sections of center panel 12 and the unglued strips of panel 11 adhere to the glued sections of end panel 13.

Figure 3:
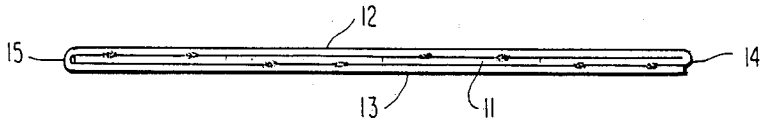
FIG. 3 is a cross-sectional view through the sealed end of the mailer bag upon completion of the folding, cutting and gluing process.
Figure 4:
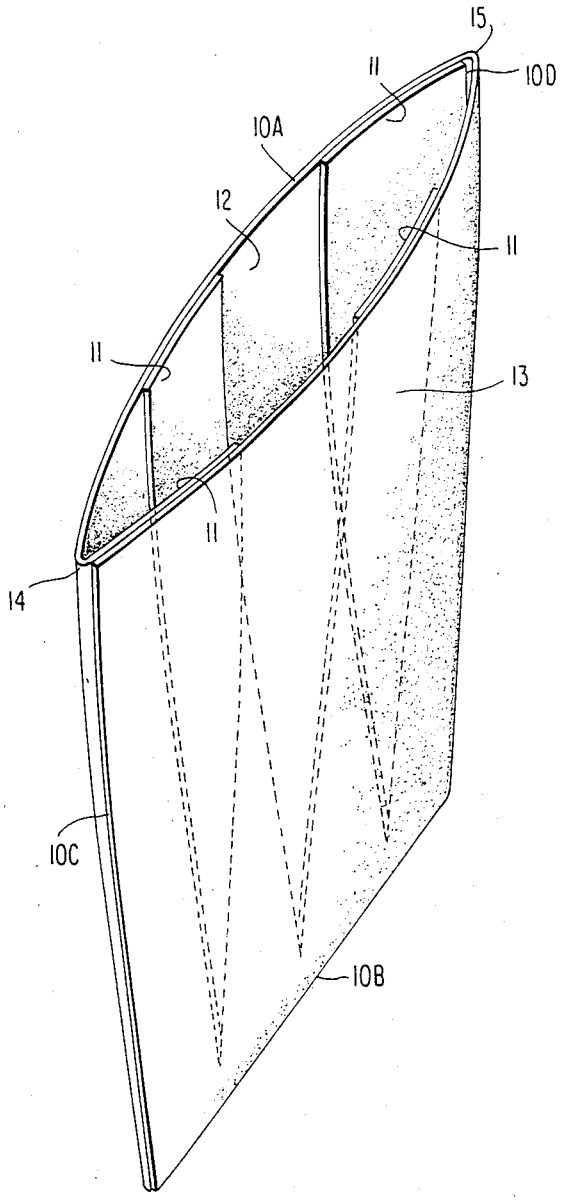
FIG. 4 is an overall view of the completed mailer bag.

By applying glue on the alternating sides of these strips and by not cutting all the way through on cut lines 18, 19 and 20, a seam is created along the edge of panel 10 opposite the leading edge, sealing it in a securer manner as shown in FIG. 3. Thus, the leading edge 10A becomes the open end of the mailer and the opposite edge 10B becomes the sealed end of the mailer.

The end result of this process is a rectangular envelope mailer bag having one sealed end and one open end ready to receive the item for packaging. After insertion of said item, the open end can be stapled, glued or otherwise sealed for delivery.

It will be apparent that the configuration of the present invention may vary in size and relative dimensions. Thus, the drawings show a generally rectangular envelope, but it may be square as well. The size may vary and includes, for example, 18 to 26 inch by 12 to 18 inch envelopes. Such variations as may become apparent to those skilled in the art from a reading of the foregoing are intended to be encompassed by the claims appended hereto.

I claim:

1. A blank for forming a shipping mailer comprising a rectilinear blank having a leading edge and an opposite parallel edge, and a pair of parallel side edges, said blank having two spaced parallel unperforated major fold lines extending transversely across the blank from the leading edge to the opposite parallel edge, and dividing the blank into one center panel and two outer panels, one of said outer panels being provided with a plurality of continuous cuts formed parallel to said major fold lines and continuously extending from said leading edge of said outer panel to a location on said outer panel substantially near said opposite parallel edge thereof thereby forming a plurality of independent rectangular flaps.

2. The blank according to claim 1, further comprising said blank being rectangular in shape.

3. The blank according to claim 1, further comprising said outer panel having three, equally spaced, parallel cut lines formed therein.

4. The blank according to claim 1, further comprising said panels being substantially equal in size.

5. The blank according to claim 1, further comprising said cuts extending across said outer panel from said leading edge up to within $\frac{1}{4}$ to $2\frac{1}{2}$ inches from said opposite parallel edge.

6. The blank according to claim 5, further comprising said cuts extending across said outer panel up to 1 inch from the opposite edge.

7. The blank according to claim 1, further comprising said blank being a rectangle of 18 to 26 inches by 12 to 18 inches.

8. A blank for forming a shipping mailer comprising a rectangular blank having a leading edge and an opposite parallel edge, and a pair of parallel side eges, said blank having two spaced parallel unperforated major fold lines extending transversely across the blank from the leading edge to the opposite parallel edge, and dividing the blank into three equal rectangular panels, said side edges being shorter in dimension than the leading edge of the blank, one of said panels being provided with a plurality of equally spaced, continuous parallel cuts formed parallel to said major fold lines and continuously extending from said leading edge of said outer panel to a location on said outer panel proximate said opposite parallel edge thereby forming a plurality of independent rectangular flaps.

9. A shipping mailer for mailing formed from a blank comprising a rectilinear blank having a leading edge and an opposite parallel edge, and a pair of parallel side edges, said blank having two spaced parallel unperforated major fold lines extending transversely across the blank from the leading edge to the opposite parallel edge and dividing the blank into one center panel and two outer panels, one of said outer panels being provided with a plurality of continuous cuts formed parallel to said major fold lines and continuously extending from said leading edge of said outer panel to a location on said outer panel substantially near said opposite parallel edge thereof, thereby forming a plurality of independent rectangular flaps, said panel provided with the plurality of cuts being folded to lie between said center panel and the other of said outer panels, said independent rectangular flaps being adhered in an alternating manner to said center panel and said other of said outer panels.

10. The shipping mailer according to claim 9, further comprising said blank being rectangular in shape.

11. The shipping mailer according to claim 9, further comprising said outer panel having three, equally spaced, parallel cut lines formed therein.

12. The shipping bag according to claim 9, further comprising said panels substantially equal in size.

13. The shipping mailer according to claim 9, further comprising said cuts extending across said outer panel from said leading edge up to within $\frac{3}{4}$ to $2\frac{1}{2}$ inches from said opposite parallel edge.

14. The shipping mailer according to claim 9, further comprising said blank being a rectangle of 18 to 26 inches by 12 to 18 inches and said cuts extending across said outer panel up to 1 inch from the opposite edge.

* * * * *